US010179416B2

(12) United States Patent
Wang

(10) Patent No.: US 10,179,416 B2
(45) Date of Patent: Jan. 15, 2019

(54) UTILITY KNIFE

(71) Applicants: HANGZHOU GREAT STAR TOOLS CO., LTD, Hangzhou (CN); HANGZHOU GREAT STAR INDUSTRIAL CO., LTD, Hangzhou (CN)

(72) Inventor: Weiyi Wang, Hangzhou (CN)

(73) Assignees: HANGZHOU GREAT STAR TOOLS CO., LTD (CN); HANGZHOU GREAT STAR INDUSTRIAL CO., LTD (CN)

( * ) Notice: Subject to any disclaimer, the term of this patent is extended or adjusted under 35 U.S.C. 154(b) by 997 days.

(21) Appl. No.: 14/369,600

(22) PCT Filed: Oct. 9, 2012

(86) PCT No.: PCT/CN2012/082641
§ 371 (c)(1),
(2) Date: Oct. 22, 2015

(87) PCT Pub. No.: WO2014/000347
PCT Pub. Date: Jan. 3, 2014

(65) Prior Publication Data

US 2016/0039100 A1 Feb. 11, 2016

(30) Foreign Application Priority Data

Jun. 28, 2012 (CN) ..... 2012 1 0224220
Jun. 28, 2012 (CN) ..... 2012 2 0314821 U
Jun. 28, 2012 (CN) ..... 2012 2 0316389 U

(51) Int. Cl.
*B26B 5/00* (2006.01)
*B26B 1/02* (2006.01)
*B26B 1/04* (2006.01)

(52) U.S. Cl.
CPC ..... *B26B 5/001* (2013.01); *B26B 1/02* (2013.01); *B26B 1/042* (2013.01)

(58) Field of Classification Search
CPC .... B26B 1/02; B26B 1/04; B26B 1/08; B26B 1/10; B26B 5/001
(Continued)

(56) References Cited

U.S. PATENT DOCUMENTS 3,577,637 A 5/1971 Braginetz
4,517,741 A 5/1985 Castelluzzo
(Continued)

FOREIGN PATENT DOCUMENTS

CA 2947452 A1 * 5/2017 ..... B26B 1/02
CN 2593983 Y 12/2003
(Continued)

OTHER PUBLICATIONS

International Search Report from International Application No. PCT/CN2012/082641, dated Apr. 4, 2013, 5 pages.

*Primary Examiner* — Jason Daniel Prone
(74) *Attorney, Agent, or Firm* — Workman Nydegger

(57) ABSTRACT

The present invention discloses a utility knife, which includes a housing that has an internal chamber; a blade carrier for carrying a single blade; a locking piece for locking the single blade in the blade carrier; and a spare blade cartridge for storing more than one spare blade. The blade carrier, the locking piece and the spare blade cartridge are arranged in the internal chamber. The blade carrier is arranged to be movable between a first position and a second position, and when the blade carrier is at the first position, the blade carried by the blade carrier extends out of the housing, when the blade carrier is at the second position, the blade carried by the blade carrier retracts into the housing.

10 Claims, 14 Drawing Sheets

(58) Field of Classification Search
USPC ..... 30/155–162
See application file for complete search history.

(56) References Cited

U.S. PATENT DOCUMENTS 4,941,260 A 7/1990 Castelluzzo
5,293,690 A * 3/1994 Cassady ..... B26B 1/046 30/154
5,940,970 A 8/1999 D'Ambro, Sr. et al.
6,354,007 B1 * 3/2002 Scarla ..... B26B 1/02 30/156
6,430,816 B2 * 8/2002 Neveux ..... B26B 1/046 30/155
6,553,674 B1 * 4/2003 Budrow ..... B26B 5/001 30/162
6,675,485 B1 * 1/2004 Shih ..... B26B 1/10 30/330
6,678,958 B1 * 1/2004 Budrow ..... B26B 5/001 30/162
6,688,003 B2 * 2/2004 Scarla ..... B26B 1/02 30/156
6,807,738 B1 * 10/2004 Shih ..... B26B 1/04 30/321
6,865,816 B1 3/2005 Zajdel
6,886,257 B2 * 5/2005 Chih ..... B26B 5/001 30/162
6,915,577 B2 * 7/2005 Scala ..... B26B 1/02 30/156
6,966,113 B2 * 11/2005 Fossella ..... B26B 5/001 30/162
7,007,392 B2 * 3/2006 Ping ..... B26B 1/042 30/155
7,040,022 B2 * 5/2006 Ping ..... B26B 5/00 30/155
7,107,688 B1 * 9/2006 Critelli ..... B26B 5/001 30/162
7,134,207 B2 * 11/2006 Ping ..... B26B 5/00 30/155
7,480,997 B2 * 1/2009 Ping ..... B26B 1/046 30/159
7,581,321 B2 * 9/2009 Kain ..... B26B 1/048 30/155
7,797,835 B2 * 9/2010 Zeng ..... B26B 5/001 30/162
7,814,664 B2 * 10/2010 LeBlanc ..... B26B 5/00 30/156
7,913,397 B2 * 3/2011 van Deursen ..... B26B 1/04 30/154
7,930,829 B2 * 4/2011 Ranieri ..... B26B 5/001 30/162
8,028,420 B2 * 10/2011 Gui ..... B26B 5/001 30/162
8,074,362 B2 * 12/2011 Gui ..... B26B 1/042 30/155
8,201,336 B2 * 6/2012 De ..... B26B 5/001 30/162
8,220,161 B2 * 7/2012 Chang ..... B26B 29/02 30/162
D686,481 S * 7/2013 Robinson ..... D8/99
8,595,942 B2 * 12/2013 Ho ..... B26B 5/003 30/162
8,621,753 B2 * 1/2014 Price ..... B26B 5/001 30/162
8,689,450 B2 * 4/2014 Constantine ..... B26B 1/08 30/162
8,938,883 B2 * 1/2015 Gringer ..... B26B 5/001 30/155
9,539,733 B2 * 1/2017 Jennings ..... B26B 1/02
9,770,834 B2 * 9/2017 Wang ..... B26B 5/001
9,808,942 B2 * 11/2017 Wang ..... B26B 5/00
9,908,248 B2 * 3/2018 Wang ..... B26B 1/044
2002/0029480 A1 * 3/2002 Lin ..... B26B 5/001 30/162
2002/0056198 A1 5/2002 Ping
2005/0055833 A1 * 3/2005 Scarla ..... B26B 1/02 30/156
2005/0204567 A1 * 9/2005 Ping ..... B26B 5/00 30/161
2005/0278955 A1 * 12/2005 Lee ..... B26B 1/02 30/153
2006/0272157 A1 * 12/2006 Zeng ..... B26B 1/048 30/161
2007/0169353 A1 * 7/2007 Wu ..... B26B 1/042 30/155
2007/0214652 A1 * 9/2007 Ping ..... B26B 1/042 30/161
2007/0227012 A1 10/2007 Constantine et al.
2008/0052913 A1 * 3/2008 Cheng ..... B26B 5/00 30/157
2008/0086894 A1 * 4/2008 Sullivan ..... B26B 5/00 30/155
2009/0038160 A1 * 2/2009 Pomerantz ..... B26B 5/00 30/162
2009/0165308 A1 7/2009 Howard
2009/0165309 A1 * 7/2009 Kamb ..... B26B 1/02 30/161
2009/0199408 A1 * 8/2009 Zeng ..... B26B 1/02 30/152
2010/0018060 A1 * 1/2010 Lin ..... B26B 1/02 30/151
2010/0180449 A1 * 7/2010 van Deursen ..... B26B 5/001 30/162
2010/0223793 A1 * 9/2010 Hansen ..... B26B 5/001 30/162
2010/0281696 A1 * 11/2010 Hao ..... B26B 5/001 30/162
2010/0299935 A1 * 12/2010 Ping ..... B26B 1/042 30/161
2011/0197454 A1 * 8/2011 Zeng ..... B26B 5/001 30/162
2011/0283542 A1 * 11/2011 Wu ..... B26B 5/003 30/162
2011/0283543 A1 * 11/2011 Wu ..... B26B 5/001 30/162
2012/0023753 A1 * 2/2012 Wen ..... B26B 1/046 30/156
2012/0066910 A1 * 3/2012 Shantha ..... B26B 1/02 30/122
2012/0304472 A1 * 12/2012 Medhurst ..... B26B 1/04 30/162
2013/0247382 A1 * 9/2013 Hongquan ..... B26B 5/001 30/156
2013/0255087 A1 * 10/2013 Wang ..... B26B 1/042 30/156
2013/0276312 A1 * 10/2013 Seber ..... B26B 1/04 30/164
2014/0150268 A1 * 6/2014 Billado, Jr. ..... B26B 1/02 30/162
2014/0259686 A1 * 9/2014 Garavaglia ..... B26B 1/046 30/156
2014/0317936 A1 * 10/2014 Wu ..... B26B 5/003 30/162
2015/0029702 A1 * 1/2015 Foley ..... B26B 1/04 30/165
2015/0246451 A1 * 9/2015 Robinson ..... B26B 5/001 30/162
2016/0346941 A1 * 12/2016 Chen ..... B26B 1/08
2018/0001488 A1 * 1/2018 Wang ..... B26B 1/04

FOREIGN PATENT DOCUMENTS

CN 201098899 Y 8/2008
CN 201151123 Y 11/2008
CN 201154488 Y 11/2008
CN 201158039 Y 12/2008
CN 201224108 Y 4/2009
CN 201227817 Y 4/2009
CN 201357417 Y 12/2009
CN 201609901 U 10/2010

(56) References Cited

FOREIGN PATENT DOCUMENTS

| | | | |
|---|---|---|---|
| CN | 201776759 | U | 3/2011 |
| CN | 201907124 | U | 7/2011 |
| CN | 202011025 | U | 10/2011 |
| CN | 202071085 | U | 12/2011 |
| CN | 202607688 | U | 12/2012 |
| EP | 2868447 | A1 | 6/2015 |

* cited by examiner

UTILITY KNIFE

CROSS-REFERENCE TO RELATED APPLICATIONS

This application is a National Stage entry of PCT/CN2012/082641, filed on 9 Oct. 2012, which claims foreign priority to China application No. 201210224220.3, filed on 28 Jun. 2012, China application No. 201220316389.7, filed on 28 Jun. 2012, and China application No. 201220314821.9, filed on 28 Jun. 2012.

FIELD OF THE INVENTION

The present invention relates to a utility knife.

DESCRIPTION OF THE PRIOR ART

The U.S. Pat. No. 6,553,674 disclosed a utility knife that can automatically load the spare blades, which are stored inside of the knife, onto the blade carrier. The blade can extend from or be retracted into the knife under the function of the blade carrier. When the blade is dull, after removing the worn blade and taking back the blade carrier, the spare blade can be loaded onto the blade carrier automatically under the function of the spring element. The blade carrier has a sliding block that can move translationally, two positioning masts are arranged on the sliding block for being stuck in the notch on the blade in order to install the blade on the blade carrier, to ensure that the sliding block can move and reset smoothly, two guiding masts are arranged on the blade carrier, a spring is arranged between the blade carrier and the sliding block. In this structure for removing blade via the translational movement of the sliding block, a blind hole for the reset spring and the holes matching with the guiding masts are needed to be arranged on the sliding block with relatively small volume. The structure is complex and the manufacturing cost is high, especially for ensuring the blade be reliably mounted on the blade carrier, two positioning masts need to be long enough to not fall out of the notch of the blade, however, due to the two long positioning masts, the sliding block needs to move a long distance when removing the blade, it makes the blade carrier thicker and thus makes the handle thicker. The two long positioning masts might obstruct the structures such as spare blades when the blade carrier is moving forward and backward, affect the flexibility of the blade carrier and increase the moving distance of the button for controlling the sliding block. This would reduce the flexibility of assembling and removing the blade.

Besides, for loading in the spare blade, an openable cover is arranged on one side of the knife, when it is needed to load the blade, open the cover, expose the blade carrier and perform the loading. The knife head of this structure is thick for ensuring the structure strength, thus causing a waste of materials and difficulties of manufacturing the components.

The utility knife disclosed by U.S. Pat. No. 6,553,674 basically can be regarded as a retractable utility knife, with deficiencies such as large volume, inconvenience in operating and carrying. Besides, the button for pushing the blade carrier protrudes out of the frame of the knife and is easy to be misoperated to make the blade extend out, potential safety risks exist.

SUMMARY OF THE INVENTION

The present invention firstly provides a utility knife, which includes a housing having an internal chamber; a blade carrier for carrying a single blade; a locking piece for locking the single blade on the blade carrier; and a spare blade cartridge for storing more than one spare blade; the blade carrier, the locking piece and the spare blade cartridge are arranged in the internal chamber, the blade carrier is arranged to be movable between a first position and a second position, and when the blade carrier is at the first position, the single blade carried by the blade carrier extends out of the housing, when the blade carrier is at the second position, the single blade carried by the blade carrier retracts into the housing; a magnetic element is arranged on the blade carrier, and the magnetic element is arranged such that when the blade carrier is empty and at the second position, the nearest spare blade to the blade carrier is transferred from the spare blade cartridge to the blade carrier by the magnetic force. Compared to elastic element, transferring the spare blade to the blade carrier by using the magnetic force of the magnetic element has the advantages that, on the one hand, the structure is simpler and the thickness of the knife head can be reduced, and on the other hand, the magnetic element can make the blade on the blade carrier be under the magnetic force all the time and attach to the blade carrier more stably.

In one embodiment, the magnetic element is of magnetic steel.

In another embodiment, the magnetic element is arranged to be imbed in the blade carrier, in order to reduce the space occupied by the magnetic element in the knife head.

In another embodiment, the locking piece has a lock tongue that matches with a notch on the back of the single blade, and the lock tongue is arranged to stay matched with the notch under the magnetic force of the magnetic element, so that no spring element is needed to make the lock tongue stay matched with the notch, and this further reduces the occupied space in the knife head.

In another embodiment, the lock tongue is arranged to pivotally match with the notch, and chamfer plane is arranged at the bottom of the lock tongue. In this way, the locking piece can retreat from the notch by only deflecting a small angle, so the space for the locking piece performing locking and unlocking actions is smaller, therefore, the knife head can be designed thinner.

In another embodiment, the lock tongue has chamfer plane on one side or two sides of the moving direction of the blade carrier, this can prevent the blade from getting stuck as a result of the possible scratch between the lock tongue and the spare blade.

In another embodiment, the spare blade cartridge is arranged to be connected to the housing via an axis pin, and is arranged to rotate around the axis pin and out of the internal chamber of the housing to load the spare blade. Compared to arranging an openable and closable cover plate on the side of the knife head in the prior art, the pivotally rotatable spare blade cartridge occupies smaller space. In a further embodiment, the spare blade cartridge has a cantilever-like flange with a hook, when loading the spare blade, the hook of the flange is arranged to match with the notch on the back of the spare blade in a snap-fit way. This snap-fit way makes the spare blade be positioned more accurately during the loading procedure, and the spare blade can be retained in the spare blade cartridge more stably.

The present invention secondly provides a utility knife, which includes a knife head having an internal chamber; a blade carrier for carrying a single blade; a locking piece for locking the single blade on the blade carrier; a spare blade cartridge for storing more than one spare blade; the blade carrier, the locking piece and the spare blade cartridge are arranged in the internal chamber, the blade carrier is arranged to be movable between a first position and a second position, and when the blade carrier is at the first position, the single blade carried by the blade carrier extends out of the housing, when the blade carrier is at the second position, the single blade carried by the blade carrier retracts into the housing; and further includes a handle; the knife head and the handle are connected via a first axis pin, and the knife head is arranged to be capable of rotating around the first axis pin to be retracted into the handle. Different from the prior art, in the present invention the knife head having a spare blade cartridge is designed as a foldable knife that can be retracted into the handle, it is more convenient for carrying and safer.

In one embodiment, a magnetic element is arranged on the blade carrier, and the magnetic element is arranged such that when the blade carrier is empty and at the second position, the nearest spare blade to the blade carrier is transferred from the spare blade cartridge to the blade carrier by magnetic force. Compared to elastic element, transferring the spare blade to the blade carrier by the using magnetic force of the magnetic element has the advantages that, on the one hand, the structure is simpler and the thickness of the knife head can be reduced, and on the other hand, the magnetic element can make the blade on the blade carrier be under the magnetic force all the time and attach to the blade carrier more stably.

In one embodiment, the magnetic element is of magnetic steel.

In another embodiment, the magnetic element is arranged to be imbed in the blade carrier, in order to reduce the space occupied by the magnetic element in the knife head.

In another embodiment, the locking piece has a lock tongue that matches with a notch on the back of the single blade, and the lock tongue is arranged to stay matched with the notch under the magnetic force of the magnetic element, so that no spring element is needed to make the lock tongue stay matched with the notch, and this further reduces the occupied space in the knife head.

In another embodiment, the lock tongue is arranged to pivotally match with the notch, and chamfer plane is arranged at the bottom of the lock tongue. In this way, the locking piece can retreat from the notch of the locking piece by only deflecting a small angle, so the space for the locking piece performing locking and unlocking actions is smaller, therefore, the knife head can be designed thinner.

In another embodiment, the lock tongue has chamfer plane on one side or two sides of the moving direction of the blade carrier, this can prevent the blade from getting stuck as a result of the possible scratch between the lock tongue and the spare blade.

In another embodiment, the spare blade cartridge is arranged to be connected to the knife head via an axis pin, and is arranged to rotate around the axis pin and out of the internal chamber of the knife head to load the spare blade. Compared to the arranging an openable and closable cover plate on the side of the knife head in the prior art, the pivotally rotatable spare blade cartridge occupies smaller space. In a further embodiment, the spare blade cartridge has a cantilever-like flange with a hook, when loading the spare blade, the hook of the flange is arranged to match with the notch on the back of the spare blade in a snap-fit way. This snap-fit way makes the spare blade be positioned more accurately during the loading procedure, and the spare blade can be retained in the spare blade cartridge more stably.

In another embodiment, an arc slot having a radial recess is arranged on the handle, and the arc slot's center is the axis of the first axis pin; a switching piece that is capable of moving between a third position and a fourth position but incapable of rotating relative to the knife head, is arranged inside of the knife head, and a block is arranged on the switching piece; the switching piece is arranged such that: when the blade carrier is at the first position, the switching piece is at the third position, meanwhile the block matches in the radial recess of the arc slot; when the blade carrier moves from the first position to the second position, the switching piece is moved from the third position to the fourth position under the function of the blade carrier, the block is moved from the radial recess to the arc slot, when the knife head is rotated around the first axis pin and retracted into the handle, the block is moving in the arc slot. In this way, when the blade carrier is at the first position, i.e. when the blade is extending out of the knife head, the knife head could not be retracted into the handle since the block is matching in the arc slot, only when the blade carrier moves to the second position, i.e. when the blade is retracted into the knife head, the block can move in the arc slot, the knife head can then be retracted into the handle. In a further embodiment, a biasing spring is further comprised, the biasing spring is arranged to abut the switching piece, when the switching piece is moved from the third position to the fourth position under the function of the blade carrier, the biasing spring is compressed to bias the switching piece. In this way, when the knife head is unfolded and the blade is extending out of the knife head, i.e. when the blade carrier is at the first position, the block re-matches into the radial recess under the function of the biasing spring.

The present invention thirdly provides a utility knife, which includes a housing having an internal chamber; a blade carrier for carrying a single blade; a locking piece for locking the single blade on the blade carrier; and a spare blade cartridge for storing more than one spare blade; the blade carrier, the locking piece and the spare blade cartridge are arranged in the internal chamber, the blade carrier is arranged to be movable between a first position and a second position, and when the blade carrier is at the first position, the single blade carried by the blade carrier extends out of the housing, when the blade carrier is at the second position, the single blade carried by the blade carrier retracts into the housing; the spare blade cartridge is connected to the housing via an axis pin, and the spare blade cartridge is arranged to rotate around the axis pin and out of the internal chamber to load the spare blade. In a further embodiment, the spare blade cartridge has a cantilever-like flange with a hook, when loading the spare blade, the hook of the flange is arranged to match with a notch on the back of the spare blade in a snap-fit way. This snap-fit way makes the spare blade be positioned more accurately during the loading procedure, and the spare blade can be retained in the spare blade cartridge more stably.

The present invention fourthly provides a utility knife, which includes a housing having an internal chamber; a blade carrier for carrying a single blade; a locking piece for locking the single blade on the blade carrier; and a spare blade cartridge for storing more than one spare blade; the blade carrier, the locking piece and the spare blade cartridge are arranged in the internal chamber, the blade carrier is arranged to be movable between a first position and a second position, and when the blade carrier is at the first position, the single blade carried by the blade carrier extends out of the housing, when the blade carrier is at the second position, the single blade carried by the blade carrier retracts into the housing; the locking piece has a lock tongue which matches with a notch on the back of the single blade, and the lock tongue is arranged to pivotally match with the notch. Compared to the way of translational moving, the way of pivotally rotating by which the lock tongue matches with the notch, makes the distance smaller and saves more space.

In one embodiment, chamfer plane is arranged at the bottom of the lock tongue. In this way, the locking piece can retreat from the notch of the locking piece by only deflecting a small angle, so the space for the locking piece performing locking and unlocking actions is smaller, and the knife head can be designed thinner.

In another embodiment, the lock tongue has chamfer plane on one side or two sides of the moving direction of the blade carrier, this can prevent the blade from getting stuck as a result of the possible scratch between the lock tongue and the spare blade.

Referencing now to the figures, the conception, detailed structure and induced technical effect of the present invention would be expounded for due understanding of the purpose, characterizations and effects of the present invention.

DETAILED DESCRIPTION OF THE PREFERRED EMBODIMENTS

Figure 1:
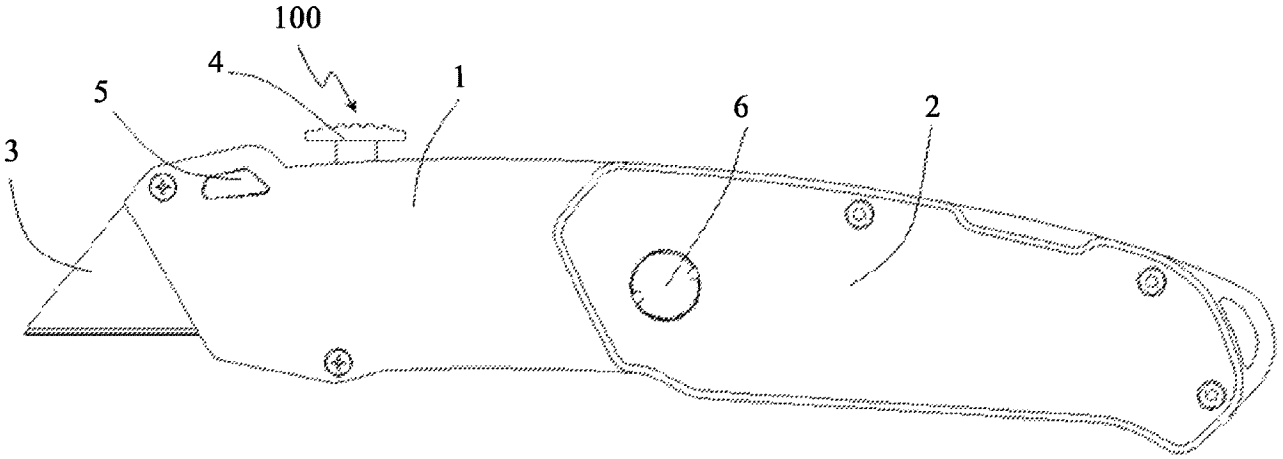
FIG. 1 is a front view of a preferred embodiment of the present invention, and the blade is extending out of the knife head.
Figure 2:
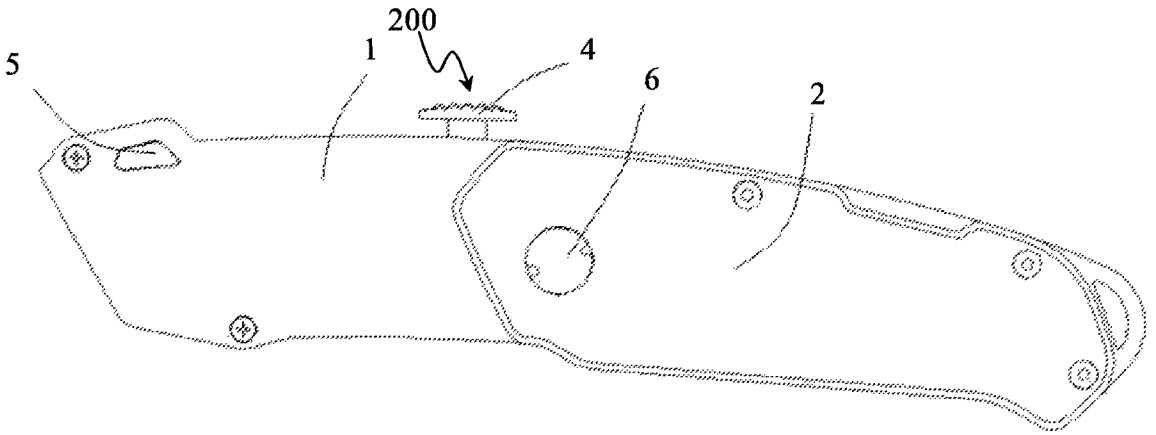
FIG. 2 is a front view of the utility knife shown in FIG. 1, and the blade is retracted into the knife head.

According to a preferred embodiment of the present invention, a foldable utility knife with a spare blade cartridge is shown in FIG. 1, 2. The foldable utility knife shown in FIG. 1 is in a state suitable for the work of cutting and etc., at this time, the knife head 1 has extended from the handle 2, and the thumb button 4 has been pressed down and slided to the first position 100 to force the blade 3 to extend from the knife head 1. At this time, if the blade 3 needs to be replaced for it is dull or any other reasons, the blade 3 can be directly pulled out from the knife head 1 by only pressing the unlocking button 5, then by pressing down the thumb button 4 and returning it to the second position 200 shown in FIG. 2, loading procedure of the blade is completed automatically. Then by pressing down the thumb button 4 again and pushing it forward to the first position 100, a new blade 3 will extend from the knife head 1 for use.

Figure 21:
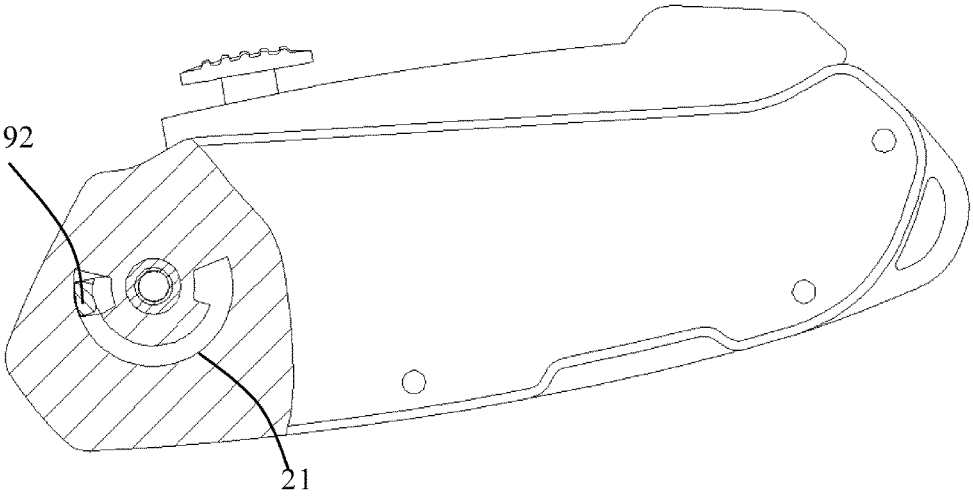
FIG. 21 is an sectional view of the utility knife shown in FIG. 1 and FIG. 2, which is retracted into the handle.

In a preferred embodiment, the knife head 1 and the handle 2 are connected via the first axis pin 6. Similar to a regular foldable knife, the knife head 1 can rotate around the first axis pin 6 and be retracted into the handle 2, as shown in FIG. 21.

Figure 3:
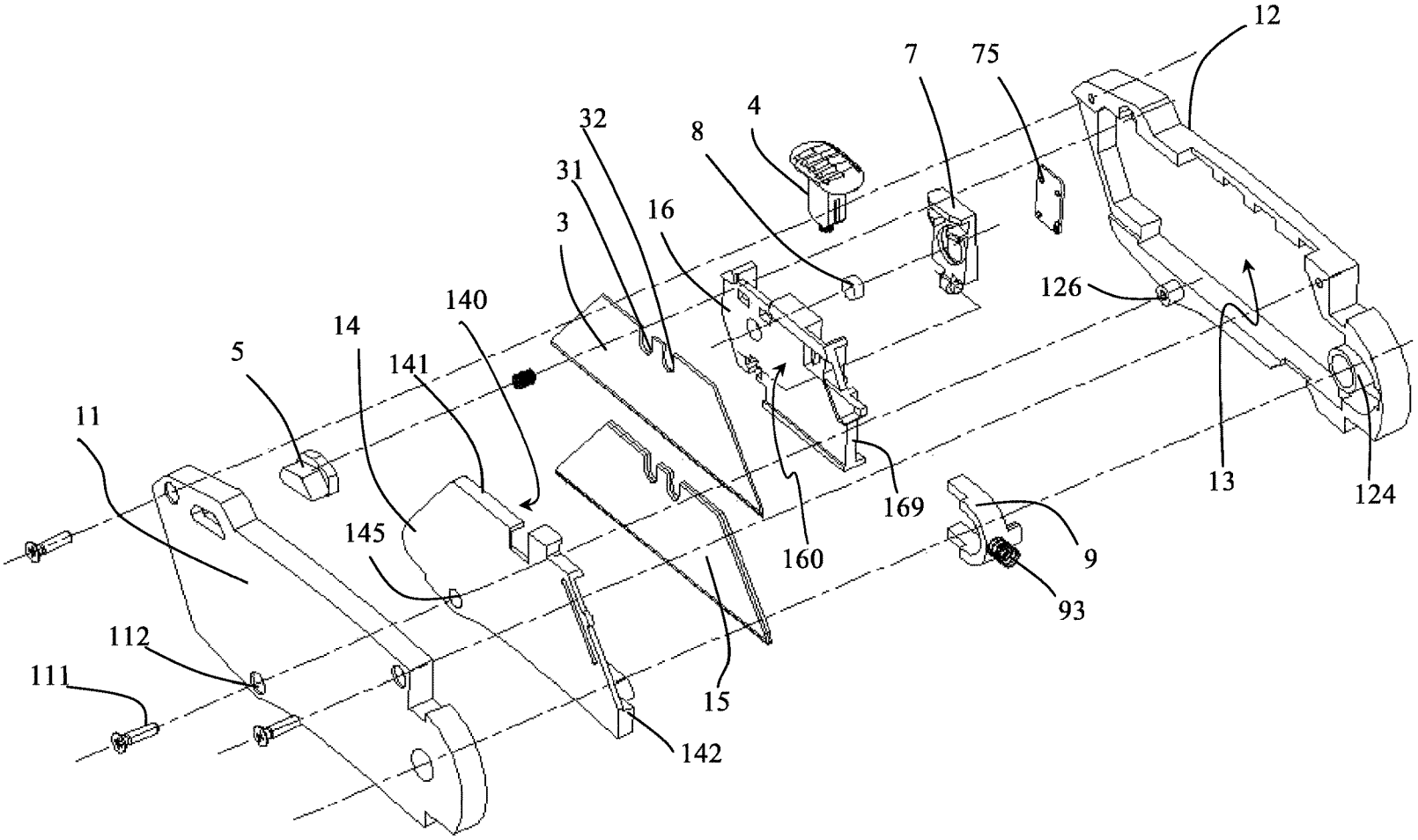
FIG. 3 is an exploded view of the utility knife shown in FIG. 1.

FIG. 3 is an exploded view of the knife head 1. As shown in FIG. 3, the housing of knife head 1 is combined by a first housing 11 and a second housing 12, and thus defines an inner chamber 13 in the knife head 1. A spare blade cartridge 14 and a blade carrier 16 is arranged in parallel in the inner chamber 13. In the inner chamber 13, the spare blade cartridge 14 is on the side adjacent to the first housing 11, and blade carrier 16 is on the side adjacent to the second housing 12. The blade carrier 16 is arranged to be able to move forward and backward between the first position 100 and the second position 200 in the inner chamber 13, and when the blade carrier 16 carrying the blade 3 moves to the second position 200, the blade 3 on the blade carrier 16 is aligned and adjoined with more than one spare blade 15 in the spare blade cartridge 14.

Figure 12:
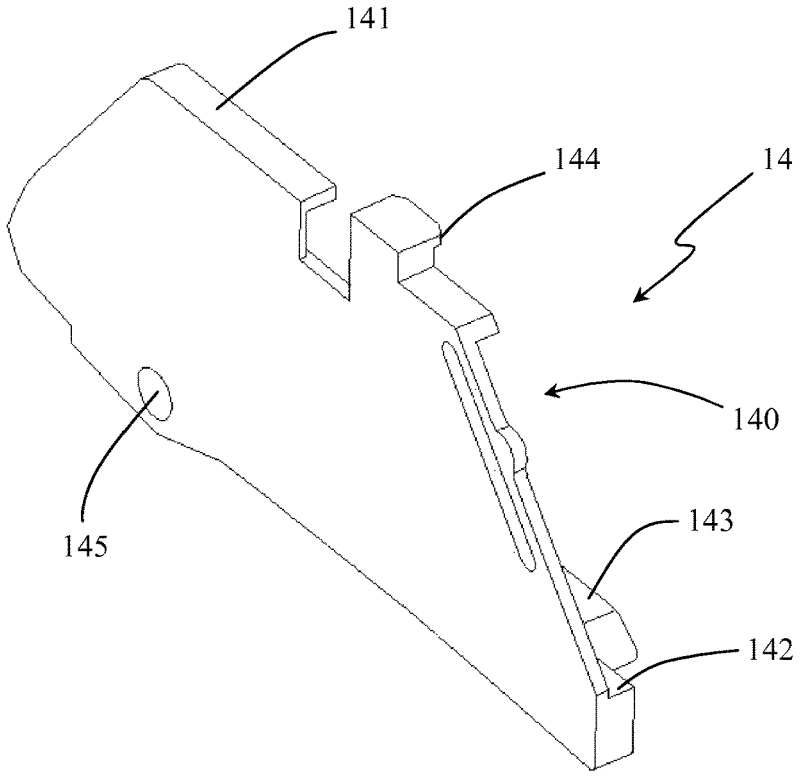
FIG. 12 is a perspective view of the spare blade cartridge shown in FIG. 3.

As shown in FIG. 3 and FIG. 12, the spare blade cartridge 14 has a blade caging frame on the side 140 facing the blade carrier 16, the blade caging frame comprises flanges 141, 142 extending from the side 140, the spare blades 15 are maintained between the flanges 141, 142.

Figure 4:
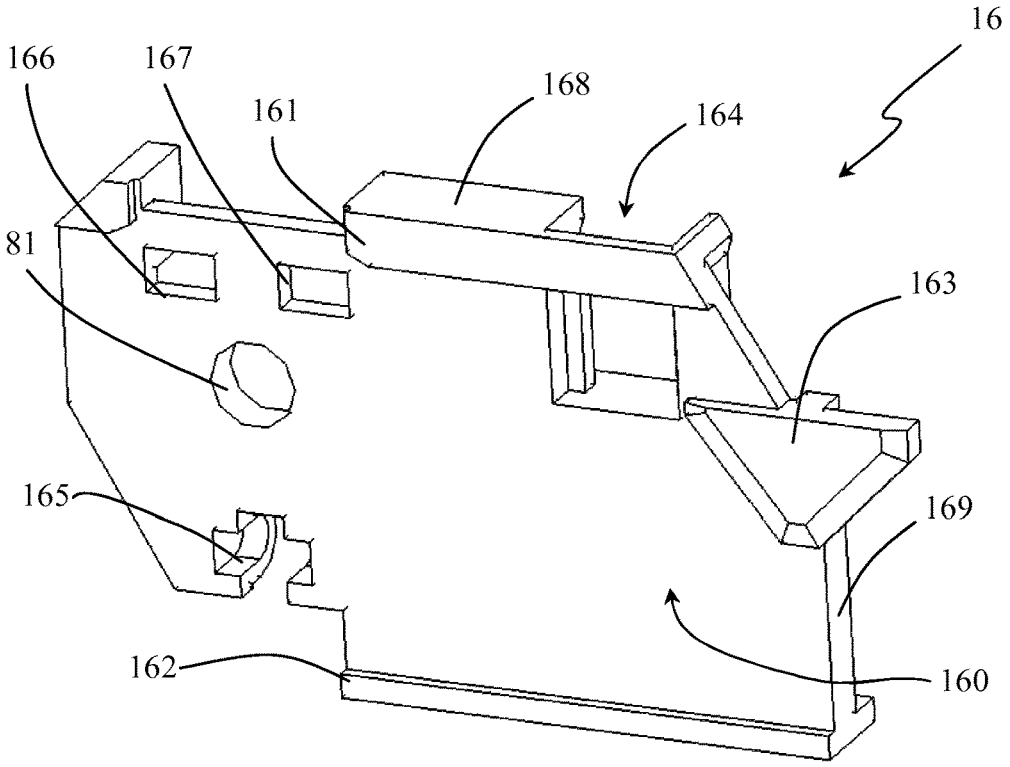
FIG. 4 is a perspective view of the blade carrier shown in FIG. 3.

As shown in FIG. 3 and FIG. 4, the blade carrier 16 has a blade caging frame on the side 160 facing the spare blade cartridge 14, the blade caging frame comprises flanges 161, 162 extending from the side, the blade 3 is retained between the flanges 161 and 162. The blade carrier 16 also has the platform 163 being flush with the blade 3 carried on the blade carrier 16, when the blade 3 moves away from the second position 200 along with the blade carrier 16, the platform 163 replaces the blade 3 and abuts the spare blades 15 to make the spare blades 15 stay in the original position.

Figure 5:
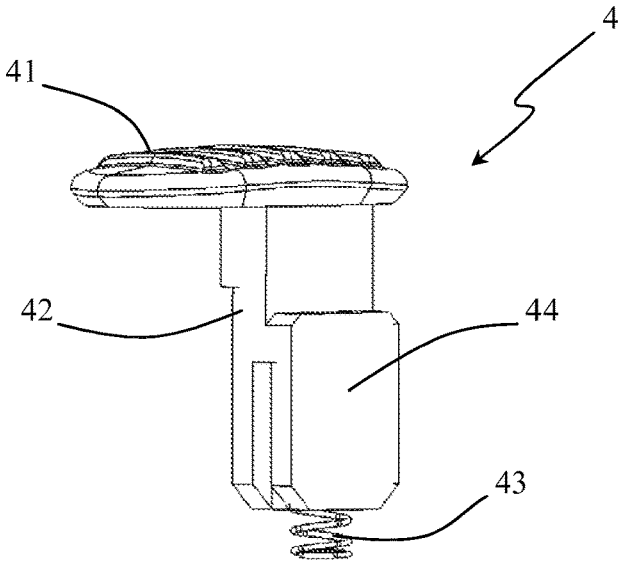
FIG. 5 is a perspective view of the thumb button shown in FIG. 3.
Figure 6:
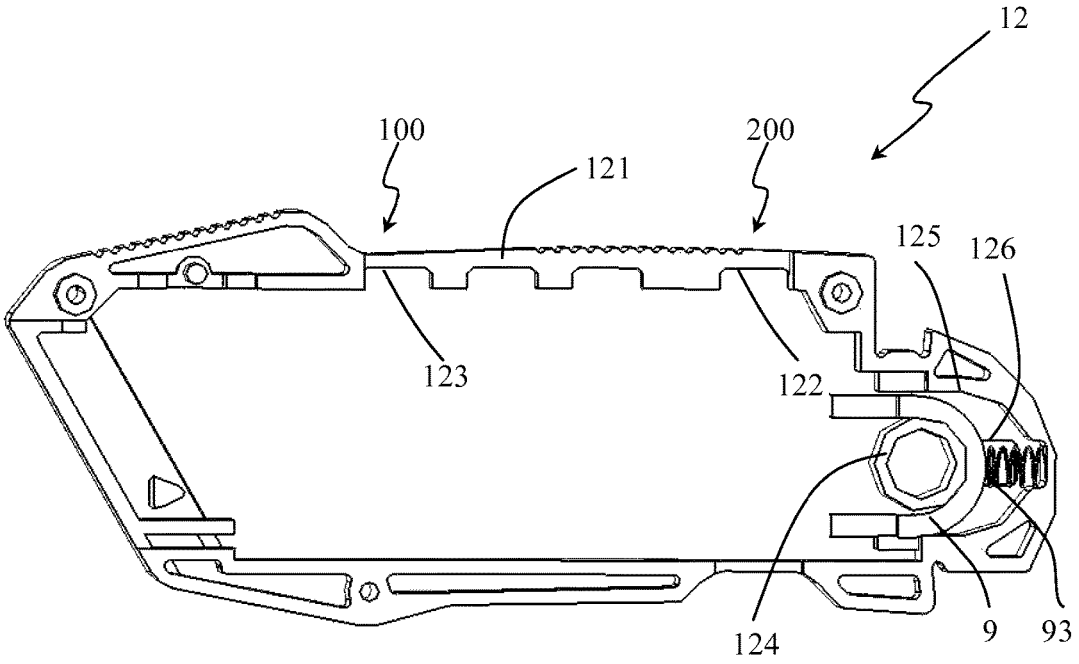
FIG. 6 is a perspective view of the second housing shown in FIG. 3.

The thumb button 4 is arranged on the blade carrier 16. As shown in FIGS. 3, 4 and 5, the thumb button 4 includes a pressing part 41, an inserting part 42 and a spring 43. The slot 164 for receiving the inserting part 42 is arranged on the blade carrier 16. When the inserting part 42 is inserted into the slot 164, the locking block 44 is arranged on the side that is facing the second housing 12. As shown in FIG. 6, the track 121 and a plurality of recesses matching with the locking block 44 are arranged along the moving direction of the thumb button 4 on the second housing 12, the recesses at least includes recesses 122, 123 shown in FIG. 6. When press down the pressing part 41, the spring 43 is compressed, the locking block 44 declines below the recesses 122, 123, at this time, the thumb button 4 can be pushed to move forward and backward in the track 121. When the locking block 44 moves to the place right under the recess 122, release the pressing part 41, the locking block 44 moves upward under the function of the spring 43, and is stuck into the recess 122, the thumb button 4 can no longer move forward or backward, and at this time, the blade carrier 16 is positioned at the second position 200. When the locking block 44 moves to the place right under the recess 123, release the pressing part 41, the locking block 44 moves upward under the function of the spring 43, and is stuck into the recess 123, the thumb button 4 can no longer move forward or backward, and at this time, the blade carrier 16 is positioned at the first position 100.

It should be pointed out that, in the present embodiment, the thumb button 4 is arranged on the side of the blade carrier 16 that is facing the second housing 12 (i.e. the side opposite to the side 160), and only matches with the recess on the second housing 12, the spare blade cartridge 14 or the first housing 11 is not involved, this provides conditions for arranging that the relatively independent spare blade cartridge 14 pivotally rotating the spare blade 15 out from the knife head 1 to load in the further embodiment that would be elaborated later.

Figure 7:
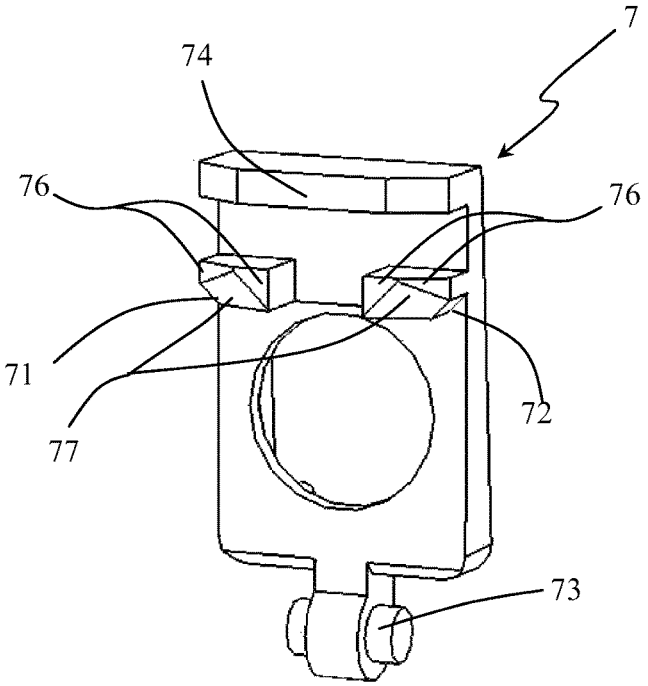
FIG. 7 is a perspective view of the locking piece shown in FIG. 3.
Figure 22:
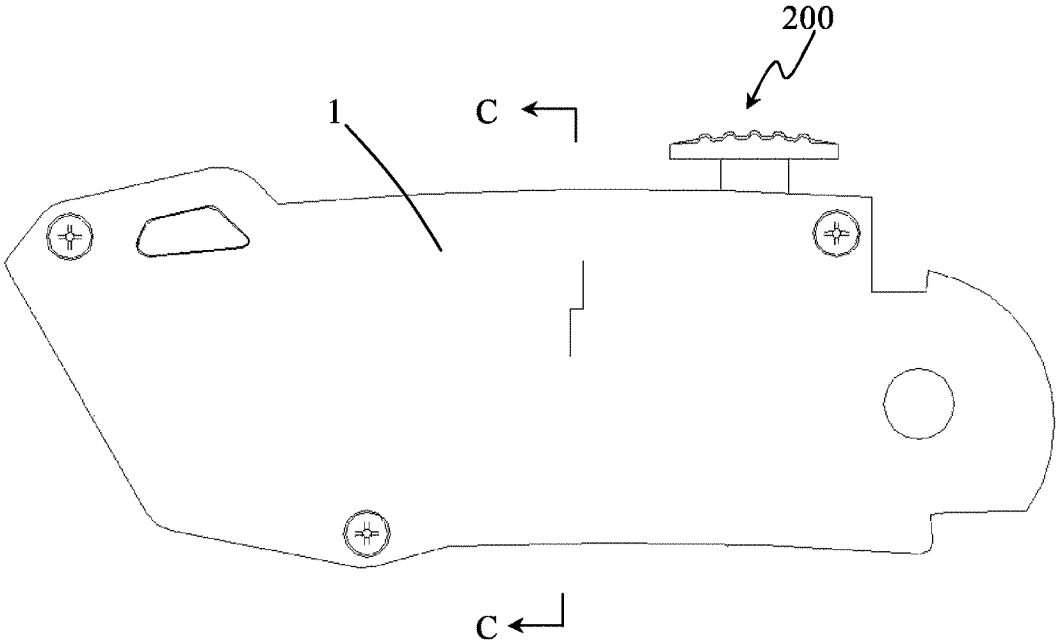
FIG. 22 is a front view of the knife head shown in FIG. 2.
Figure 23:
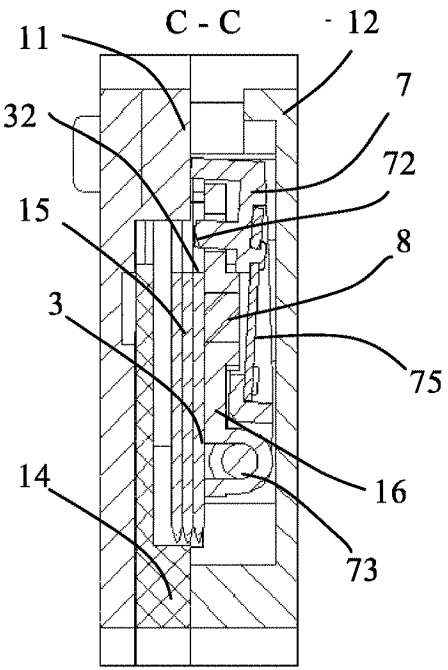
FIG. 23 is a cross-sectional view taken along line C-C of the knife head shown in FIG. 22.

As shown in FIG. 3 and FIG. 7, in the prior art two notches 31, 32 are arranged on the back of the blade 3 and the spare blades 15, and the locking piece 7 has lock tongues 71, 72 that match with the notches 31, 32. As shown in FIG. 22 and FIG. 23, when the blade 3 is at the second position 200, the notches 31, 32 match with the locking piece 7 on the blade carrier 16 to lock the blade 3 on the blade carrier 16, this makes the blade 3 be able to move forward and backward between the first position 100 and the second position 200 with the blade carrier 16, and makes the blade 3 stable when it performs cutting or other work at the first position 100. In the U.S. Pat. No. 6,553,674, the locking piece 106 is arranged to translationally move perpendicular to the blade 72 under the function of the external force to make the lock tongue 100, 102 reach into the notches 78, 76 or retreat from the notches 78, 76 to accomplish locking or unlocking the blade 72. The defect of the translational movement is that when performing locking and unlocking, the traveling distance of locking piece is relatively long and the lateral space needed is large, this makes the knife head thicker.

Figure 8:
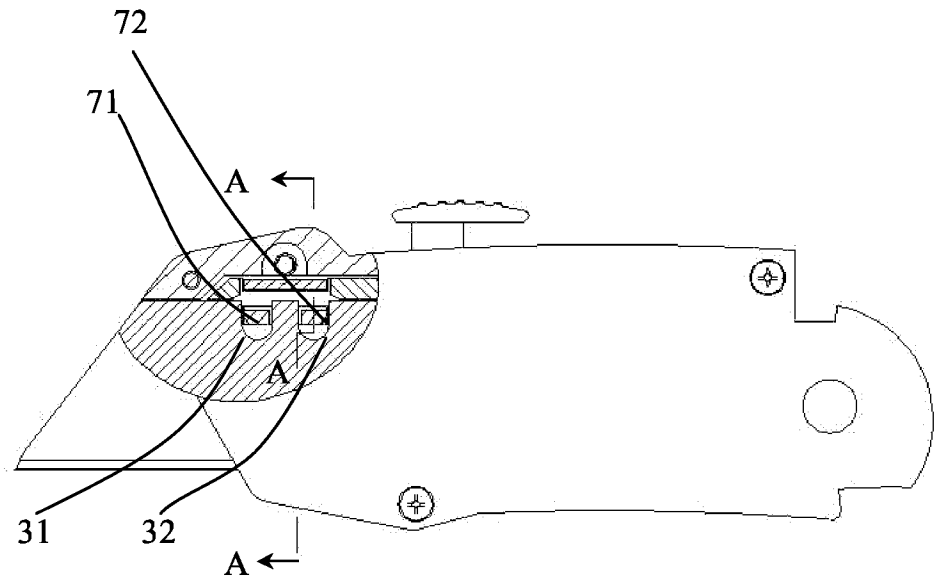
FIG. 8 is a sectional view of the knife head shown in FIG. 1.
Figure 9:
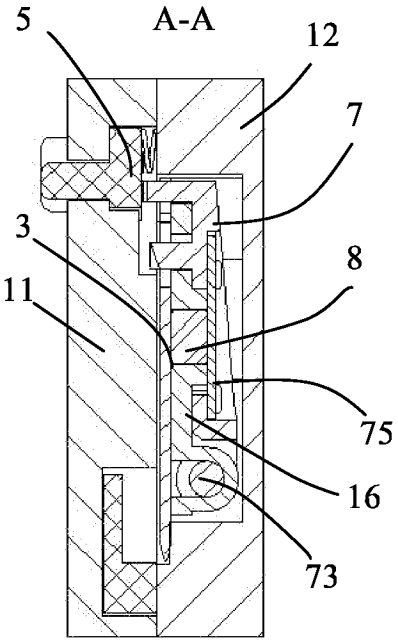
FIG. 9 is a cross-sectional view taken along line A-A of the knife head shown in FIG. 8, at this time, the unlocking button is not pressed down.
Figure 10:
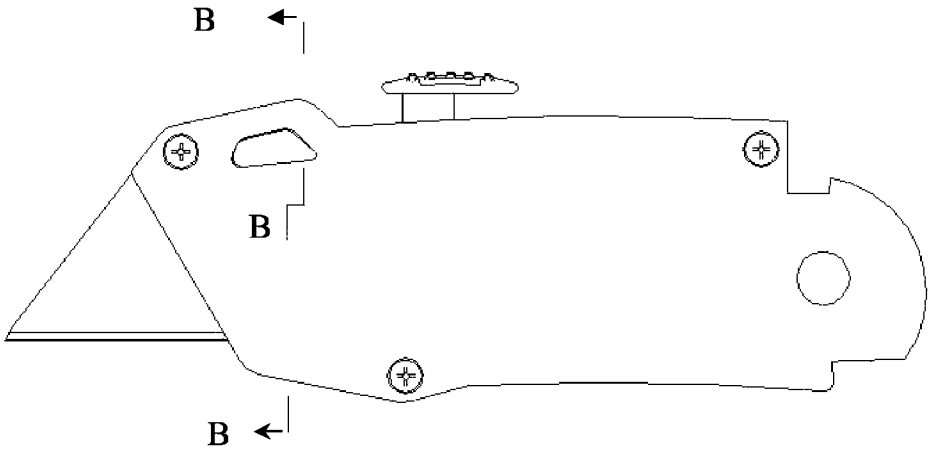
FIG. 10 is a front view of the knife head shown in FIG. 1.
Figure 11:
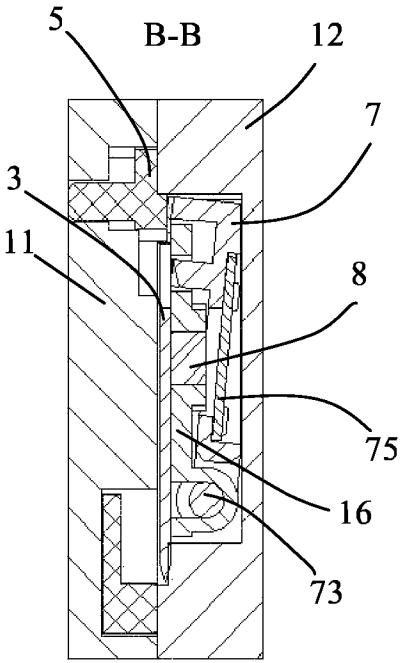
FIG. 11 is a cross-sectional view taken along line B-B of the knife head shown in FIG. 10, at this time, the unlocking button is pressed down.

Different from the translational movement in the U.S. Pat. No. 6,553,674, the locking piece 7 in the present embodiment adopts a pivotally rotating way to lock and unlock the blade 3. As shown in FIGS. 3, 4 and 7, the locking piece 7 in the present embodiment comprises a pivot part 73, the pivot part 73 matches into the pivot recess 165 that is arranged on the side 160 of the blade carrier 16, thus the locking piece 7 can pivotally rotate around the pivot recess 165 on the side that is opposite to the side 160. Further, the magnetic element 8 is arranged in the blade carrier 16. In the present embodiment, the magnetic element 8 is a magnetic steel embed in the embedding hole 81 on the blade carrier 16. In the locking status, the locking piece 7 stays in the upright position under the magnetic force of magnetic steel, at this time, the lock tongues 71, 72 pass through the openings 166, 167 and reach into the notches 31, 32, as shown in FIG. 23. Additionally, as shown in FIG. 8, 9, when the blade carrier is at the first position 100, the abutting part 74 of the locking piece 7 is aligned with the unlocking button 5, and both of them are above the back of the blade 3. At this time, press down the unlocking button 5, the unlocking button 5 will push the abutting part 74 of the locking piece 7 to make the locking piece 7 pivotally rotate around the pivot recess 165, and make the lock tongues 71, 72 retreat from the notches 31, 32, at this time the blade 3 is in the unlocking status, as shown in FIGS. 10, 11. When the thumb button 5 is released, the locking piece 7 will automatically return to the upright position under the magnetic force of magnetic steel. Further, to reduce weight or facilitate processing, the body of the locking piece 7 can be made of plastics or light alloy material, at this time, additional parts that can be attracted by the magnetic force of the magnetic element 8 can be arranged on the locking piece 7, such as the thin steel sheet 75.

It should be pointed out that, the effect exerted on the locking piece 7 by the magnetic element 8 can be replaced by the spring element, such as spring or reed, i.e. the locking piece 7 can take advantage of the spring element such as spring or reed to make itself stay or return to the aforementioned upright position. However, the magnetic element 8 can be simply embedded in the blade carrier 16, it is easy to install and occupies no extra space, and thus reduces the thickness of the knife head 1.

It can be understood that, when the blade carrier 16 is at the second position 200, the lock tongues 71, 72 can be preferably arranged to be at most flush with the blade 3, as shown in FIG. 23. As can be seen obviously from FIG. 7, in the present embodiment, chamfering is performed to the two sides of the direction of the back and forth movement of the lock tongue 71, 72 of the locking piece 7, so that the first chamfer planes 76 are formed as shown in the figure. It can be understood that, the chamfering can be performed only to one of the lock tongue 71, 72 or to one side as needed. Moreover, fillets can be performed so that the first chamfer planes 76 formed in this way would be an arc plane.

Besides, in the present invention, chamfering is performed at the bottom of the lock tongues 71, 72, and the second chamfering plane 77 is formed as shown in FIG. 7, in this way, the locking piece 7 can deflect a relatively small angle around the pivot recess 165 to make the lock tongue 71, 72 retreat from the notches 31, 32 of the blade 3, this reduces the traveling distance needed for unlocking the locking piece 7, and further reduced the thickness of the knife head 1.

When unlocking button 5 is pressed down, the blade 3 is in the unlocking status. At this time, if the blade 3 needs to be replaced, the blade 3 can be pulled out directly from the knife head 1, and then press the thumb button 4 to drive the empty blade carrier 16 back to the second position 200. Under the magnetic force of the magnetic steel 8, one or more spare blades 15 in the spare blade cartridge 14 as a whole move translationally to the side 160 of the blade carrier 16, wherein the nearest spare blade 15 to the side 160 is now completely attach to the side 160, at the same time the lock tongues 71, 72 would also reach into the notches 31, 32 of the spare blade 15 to lock it. It means that the spare blade 15 has been transferred to the blade carrier 16, and becoming the new blade 3, the process of loading blade has been accomplished automatically.

It should to be pointed out that, as disclosed in the U.S. Pat. No. 6,553,674, the spare blade 74 can also be transferred to the blade carrier 44 from the spare blade cartridge 84 under the biasing force of the spring element.

For the foldable utility knife, since the knife head is folded into the handle, the knife head had better to be as thin as possible, otherwise the knife as a whole would be too thick, which is inconvenient to operate or to carry. In the present embodiment, the application of the magnetic element 8 does not need the spring element matching with the locking piece 7 and occupying the extra space as well as the spring element for loading the blade, and further reduces the thickness of the knife head 1.

Besides, different from the openable and closable cover arranged on the side of the knife 10 in the U.S. Pat. No. 6,553,674, the spare blade cartridge 14 in the present embodiment is arranged to be able to pivotally rotate out of the knife head 1 to load the spare blade 15.

Figure 13:
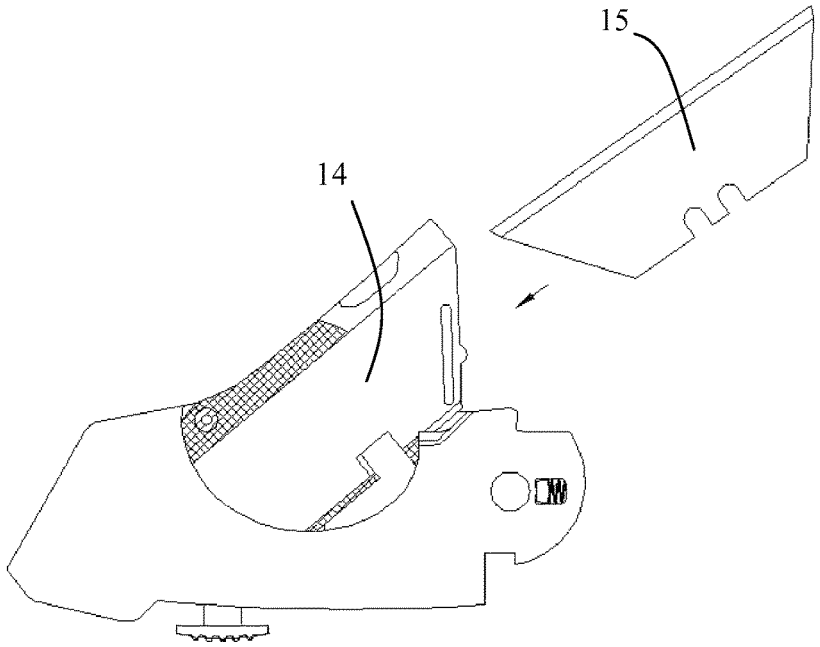
FIG. 13 shows the spare blade cartridge shown in FIG. 3, which is pivotally rotated out of the knife head to load the spare blade.

As shown in FIGS. 3, 12, 13, the spare blade cartridge 14 is pivotally connected to the knife head 1 between the first housing 11 and the second housing 12 via the second axis pin 111 and pin holes 112, 145, 126, and the knob 143 exposed out of the second housing 12 is arranged on the edge of the spare blade cartridge 14 for convenient manual operations. When the knife head 1 is in the expanded status as shown in the FIGS. 1, 2, the spare blade cartridge 14 can pivotally rotate out around the second axis pin 111 by the hand prodding the knob 143, and then the spare blade 15 is loaded into the spare blade cartridge 14, as shown in FIG. 13. Further, in the present embodiment, the positioning flange 144 is arranged on the spare blade cartridge 14, the positioning flange 144 extends from the side 140 of the spare blade cartridge 14 and exceeds the flanges 141, 142, and above the upper face 168 of the blade carrier 16 in the vertical direction. When the blade carrier 16 is at the second position 200, since the positioning flange 144 is abutting the upper face 168 of the blade carrier 16, at this time, the spare blade cartridge 14 could not be pulled out of knife head 1. When the blade carrier 16 is at the first position 100, the positioning flange 144 is not obstructed by the upper face 168 of the blade carrier 16, at this time, the spare blade cartridge 14 can be pulled out of knife head 1.

Figure 14:
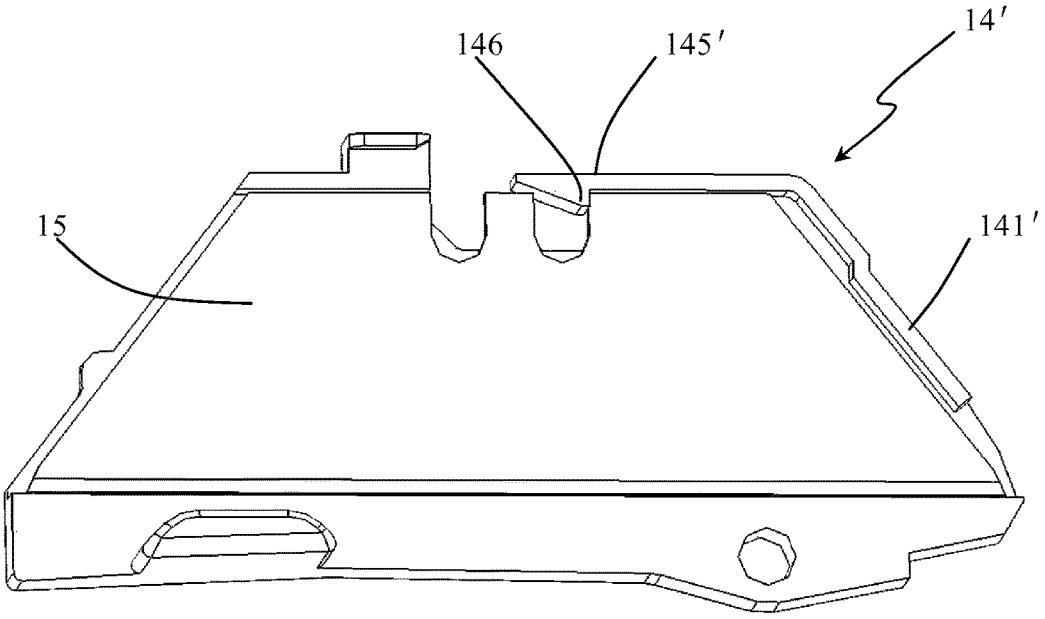
FIG. 14 is a perspective view of the spare blade cartridge shown in FIG. 3 in another embodiment.
Figure 15:
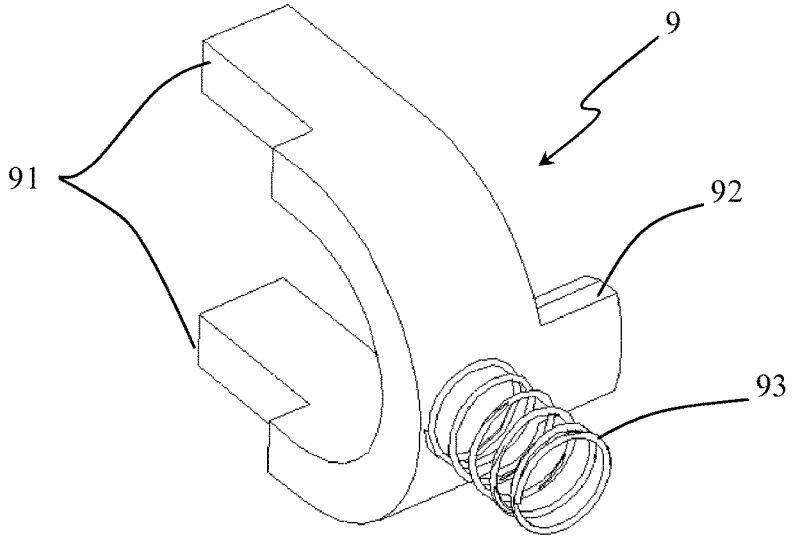
FIG. 15 is a perspective view of the switching piece shown in FIG. 3.
Figure 16:
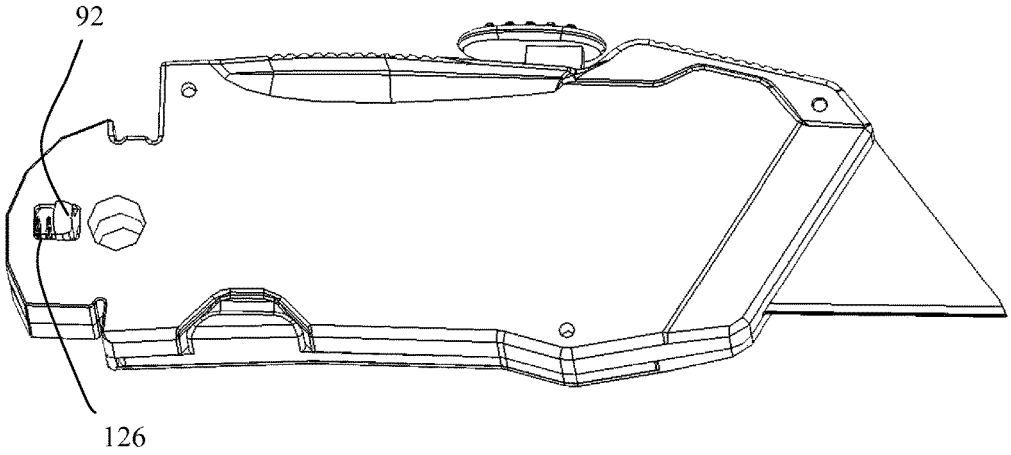
FIG. 16 is a perspective view of the knife head shown in FIG. 1.
Figure 17:
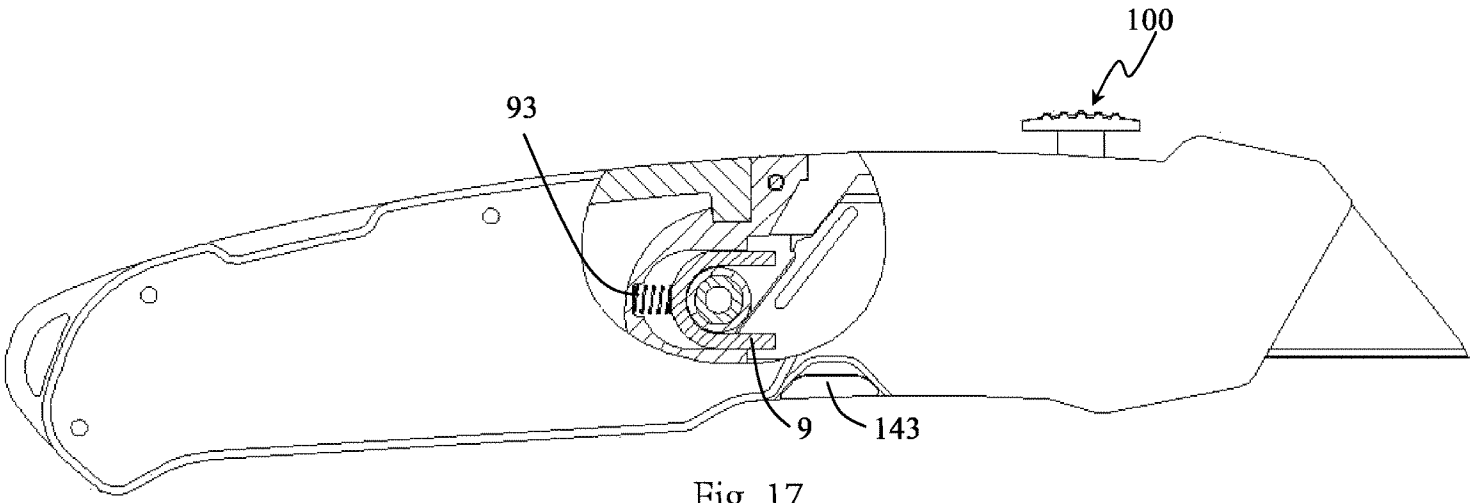
FIG. 17-18 are sectional views of the utility knife shown in FIG. 1.
Figure 18:
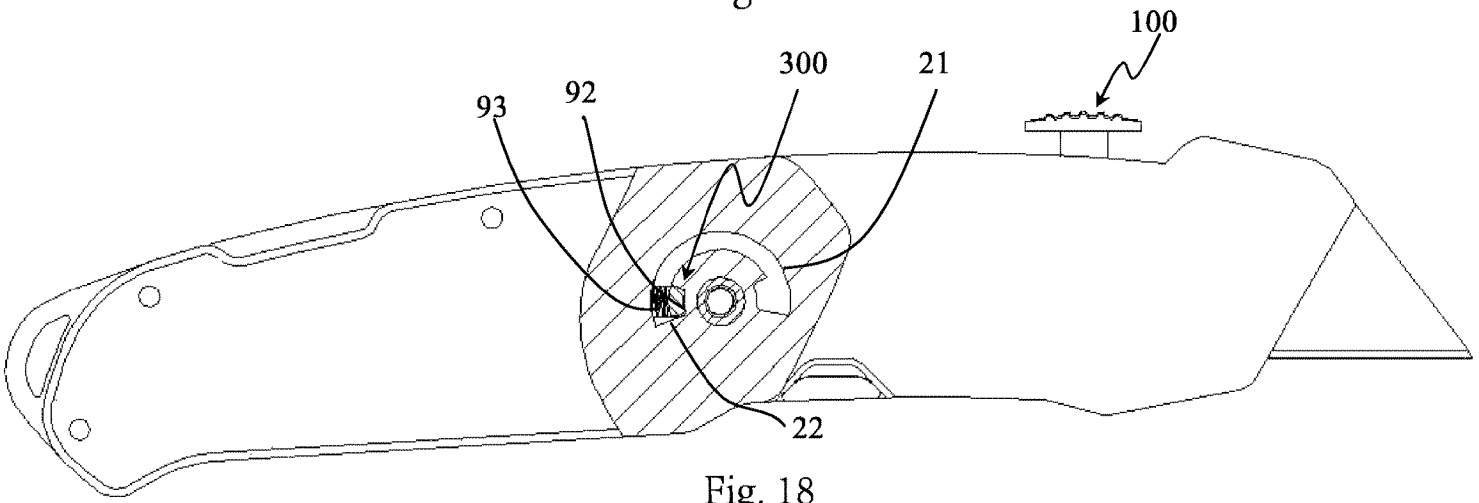
Figure 19:
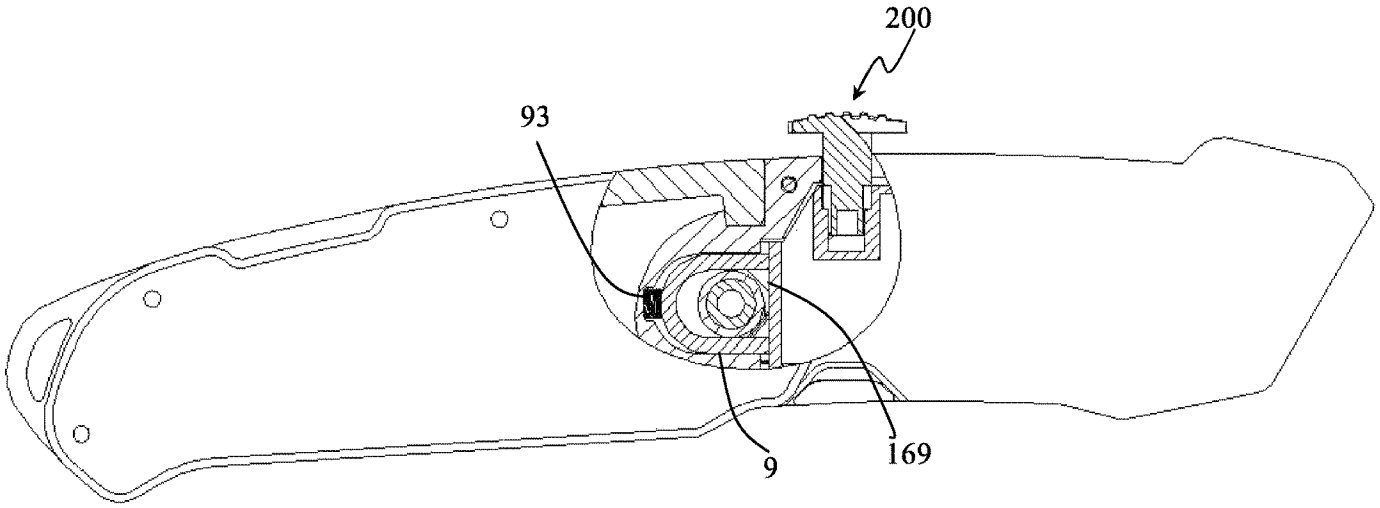
FIG. 19-20 are sectional views of the utility knife shown in FIG. 2.
Figure 20:
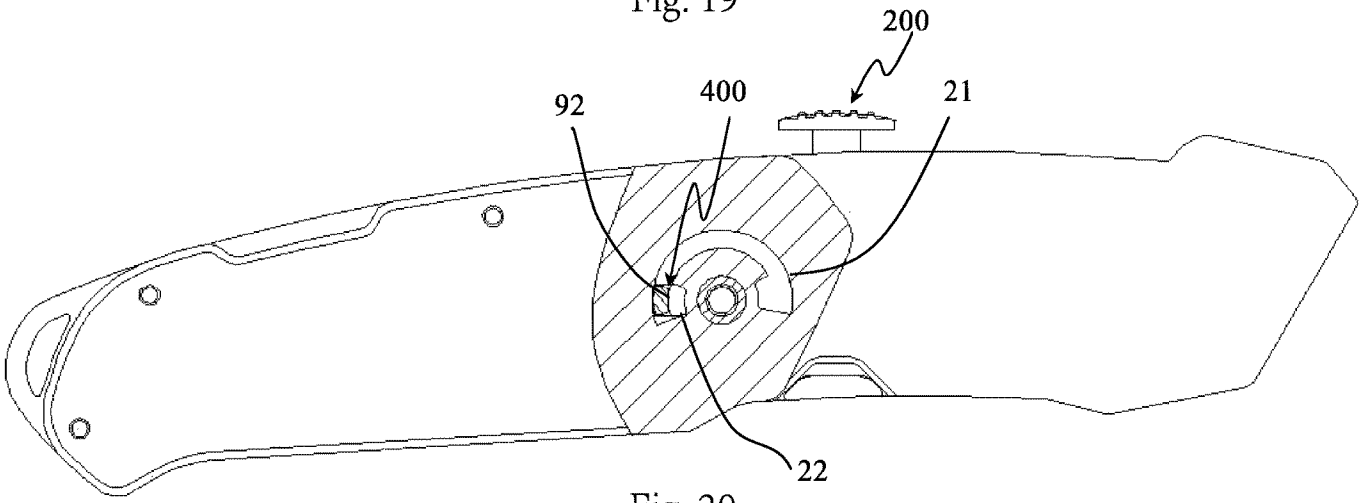

FIG. 14 shows another preferred embodiment 14' of the spare blade cartridge 14. As shown in FIG. 14, in this embodiment, a part of the flange 141' of the spare blade cartridge 14' is of a cantilever 145' structure, the hook 146 is arranged at the ends of the cantilever 145'. In this way, when the spare blade 15 is loaded into the spare blade cartridge 14' as shown in FIG. 13, the hook 146 can be clamped into the notch 31 or notch 32 on the spare blade 15 in a snap-fit way, thus the spare blade 15 is clamped in the spare blade cartridge 14'. Besides, since the hook 146 is also a part of the flange 141' of the spare blade caging frame, the hook 146 also has guiding effect when the spare blade 15 moves towards the side 160 of the blade carrier 16 in the blade-loading process.

Figure 24:
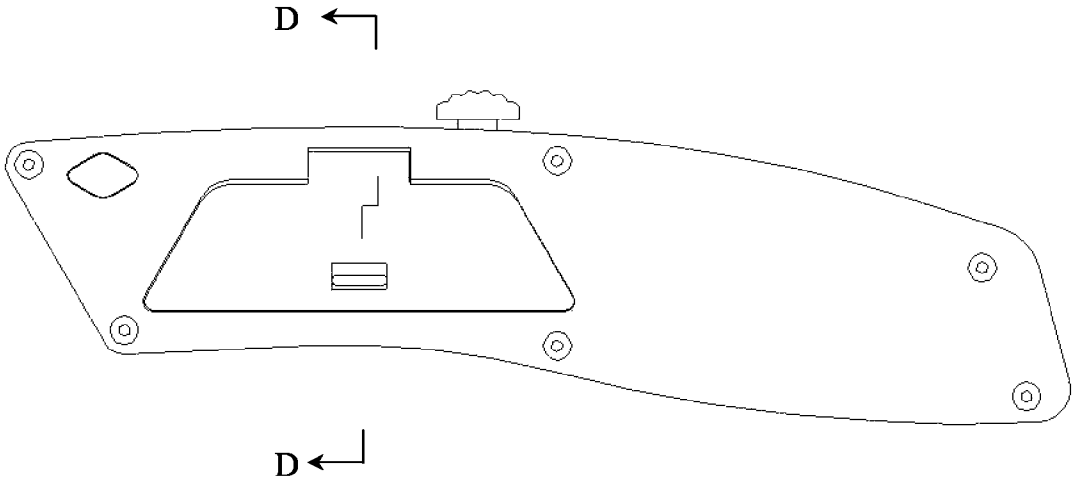
FIG. 24 is a front view of the utility knife in another embodiment of the present invention.
Figure 25:
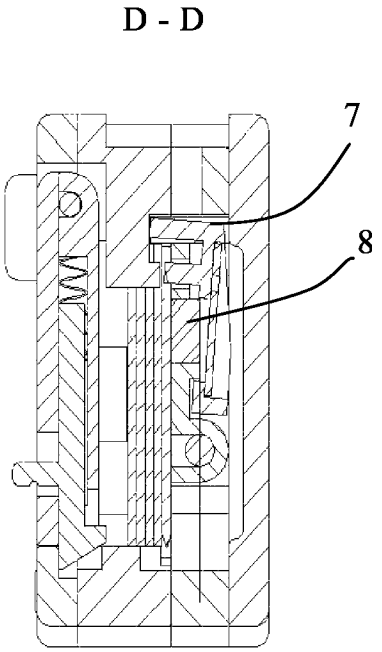
FIG. 25 is a cross-sectional view taken along line D-D of the knife head shown in FIG. 24.

The above describes in detail the knife head 1 in a preferred embodiment of the present invention. It should be pointed out that, although the present preferred embodiment is a foldable utility knife, all the disclosed technical features of the knife head 1 can still be individually or collectively applied to other foldable or unfoldable utility knives, such as the utility knife disclosed in the U.S. Pat. No. 6,553,674, for the person skilled in the art, this application does not need inventive work. In the present application, the embodiment of the unfoldable utility knife shown in FIGS. 24, 25, applies the aforementioned locking piece 7 and the magnetic element 8.

Further, the preferred embodiment of the present invention as shown in FIG. 1 can also be arranged such that only when the thumb button 4 and the blade carrier 16 are at the second position 200, i.e. when the blade 3 carried by the blade carrier 16 is retracted into the knife head 1, the knife head 1 can then be retracted into the handle 2.

Under this situation, as shown in FIGS. 3, 6, 15 and 16, the switching piece 9 and the biasing spring 93 are arranged in the knife head 1. In the present embodiment, the switching piece 9 is a U-shape body mounted in the holding recess 125 outside of the pipe 124 of the first axis pin 6, the pipe 124 extends from the inner side of the second housing 12. After installation, the two ends 91 of the U-shape body is aligned with the side 169 of the tail of the blade carrier 16, the block 92 that laterally extends from the head of the U-shape body passes through the opening 126 and is partially exposed out of the second housing 12. The biasing spring 93 is arranged to bias the switching piece 9 to make the head of the U-shape body of the switching piece 9 abut the pipe 124, so that the switching piece 9 is capable of moving in the knife head 1 yet incapable of rotating relative to the knife head 1. When the blade carrier 16 is at the first position 100, the block 92 is at the third position 300. When the blade carrier 16 moves to the second position 200, the side 169 of its tail pushes the two ends 91 of the switching piece 9 to make the switching piece compress the biasing spring 93 and switch to the fourth position 400, as shown in FIGS. 17-20.

As shown in FIGS. 17-20, on the handle 2, along the moving track of the block 92 at the fourth position which pivotally rotates with the retracting and extending of the knife head 1, the arc slot 21 matching with the block 92 is arranged and its center is the axis of the first axis pin 6. Besides, the radial recess 22, which is corresponding to the first position 300 of the block 92 when the knife head 1 is in the expanded status, is arranged on the arc slot 21. Therefore, when the knife head 1 is in the expanded status, and the blade carrier 16 is at the first position 100, the block 92 is matching in the radial recess 22, at this time, the knife head 1 cannot be retracted into the handle. When the blade carrier 16 is moved to the second position 200, the switching piece 9 is pushed by the blade carrier 16 to make the block 92 be off the radial recess 22 to switch into the second position 400 in the arc slot 21, at this time, the block 92 can pivotally rotate in the arc slot 21, thus the knife head 1 can be retracted into the handle 2, as shown in FIG. 21.

The foregoing description details the preferred embodiments of the invention. It should be understood that with the general technique of this field, no inventive work is necessary as to make multiple amendments and changes according to conception of this invention. Therefore, all the technical schemes gained from logical analysis, deductions or limited experimentation based on the conception of the present invention by technicians in this field, should be considered within the protection range asserted in the Claims.

The invention claimed is:

1. A utility knife, comprising a knife head having an internal chamber;

a blade carrier for carrying a single blade;

a locking piece for locking the single blade on the blade carrier, wherein the locking piece is attached to the blade carrier;

a spare blade cartridge for storing more than one spare blade; and wherein the blade carrier, the locking piece and the spare blade cartridge are arranged in the internal chamber, the internal chamber has an opening that allows for the single blade to extend outside the internal chamber and retract back into the internal chamber, the blade carrier is arranged to be movable between a first position and a second position, the blade carrier is adapted to retain the single blade with the single blade protruding from the internal chamber when the blade carrier is in the first position, and the blade carrier is adapted to retain the single blade with the single blade totally confined within the internal chamber when the blade carrier is in the second position;

and further comprising a handle;

wherein the knife head and the handle are connected via a first axis pin, and the knife head is arranged to be capable of rotating around the first axis pin to be retracted into the handle;

wherein an arc slot having a radial recess is arranged on the handle, and the arc slot has a center that aligns with a center of the first axis pin; and a switching piece with a block arranged in the internal chamber of the knife head; such that the switching piece has an end aligned with a side of a tail of the blade carrier when the blade carrier is at the first position, and such that moving of the blade carrier between the first position and the second position will cause the switching piece to be moved between a third position and a fourth position; wherein the switching piece is further arranged such that:

the block of the switching piece is engaged with the radial recess of the arc slot preventing the block from rotating when the switching piece is at the third position with the blade carrier at the first position; and the block is moved from the radial recess to the arc slot when the switching piece is moved from the third position to the fourth position, which permits the rotation of the block in the arc slot when the knife head is rotated around the first axis pin and retracted into the handle.

2. The utility knife as defined in claim 1, wherein the spare blade cartridge is arranged to be connected to the knife head via a second axis pin, and a knob is arranged on an edge of the spare blade cartridge which is configured to be capable of rotating the spare blade cartridge around the second axis pin and out of the inner chamber of the knife head to load the spare blade.

3. The utility knife as defined in claim 1, wherein further comprises a biasing spring configured to engage the knife head, and the biasing spring is arranged to abut the switching piece, when the switching piece is moved from the third position to the fourth position under the function of the blade carrier, the biasing spring is compressed to bias the switching piece.

4. The utility knife as defined in claim 1, wherein a magnetic element is arranged on the blade carrier, and the magnetic element is arranged such that when the blade carrier is at the second position and is empty, a nearest one of the spare blades to the blade carrier is transferred from the spare blade cartridge to the blade carrier by magnetic force.

5. The utility knife as defined in claim 4, wherein the magnetic element is of magnetic steel.

6. The utility knife as defined in claim 4, wherein the magnetic element is arranged to be embedded in the blade carrier.

7. The utility knife as defined in claim 4, wherein the locking piece has a lock tongue configured to engage notches on a back of the single blade, and the lock tongue is configured to engage the notches under a magnetic force of the magnetic element.

8. The utility knife as defined in claim 7, wherein the lock tongue engages the notches with a pivotal attachment, and the lock tongue has a chamfer plane on a second side opposite to the first side.

9. The utility knife as defined in claim 7, wherein the lock tongue has one or two chamfer planes on a first side thereof parallel and close to the back of the single blade.

10. The utility knife as defined in claim 9, wherein the spare blade cartridge has a flange with a hook, and the hook of the flange is configured to engage notches on a back of the spare blade.

* * * * *